US010573475B2

(12) United States Patent
Sakai et al.

(10) Patent No.: US 10,573,475 B2
(45) Date of Patent: Feb. 25, 2020

(54) GAS-BLAST CIRCUIT BREAKER

(71) Applicant: KABUSHIKI KAISHA TOSHIBA, Minato-ku (JP)

(72) Inventors: Misuzu Sakai, Kanagawa (JP); Hiroki Tashiro, Kanagawa (JP); Takayuki Masunaga, Kanagawa (JP); Katsumi Hisano, Matsudo (JP); Takahiro Terada, Kanagawa (JP); Toshiyuki Uchii, Kanagawa (JP); Takanori Iijima, Kanagawa (JP); Tomoyuki Yoshino, Kanagawa (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 16/295,624

(22) Filed: Mar. 7, 2019

(65) Prior Publication Data

US 2019/0295791 A1 Sep. 26, 2019

(30) Foreign Application Priority Data

Mar. 20, 2018 (JP) ..... 2018-052935

(51) Int. Cl.

| | |
|---|---|
| ***H01H 33/91*** | (2006.01) |
| ***H01H 33/56*** | (2006.01) |
| ***H01H 9/52*** | (2006.01) |
| ***H01H 33/72*** | (2006.01) |
| ***H01H 33/70*** | (2006.01) |

(52) U.S. Cl.

CPC ..... *H01H 33/91* (2013.01); *H01H 9/52* (2013.01); *H01H 33/56* (2013.01); *H01H 33/7069* (2013.01); *H01H 33/72* (2013.01)

(58) Field of Classification Search

None

See application file for complete search history.

(56) References Cited

U.S. PATENT DOCUMENTS 4,612,426 A * 9/1986 Maier ..... H01H 9/362 218/151
9,384,923 B1 * 7/2016 Matuszak ..... H01H 9/52
(Continued)

FOREIGN PATENT DOCUMENTS

| | | |
|---|---|---|
| JP | 61-208715 | 9/1986 |
| JP | 2003-092052 | 3/2003 |
| JP | 2015-122238 | 7/2015 |

*Primary Examiner* — Truc T Nguyen
(74) *Attorney, Agent, or Firm* — Oblon, McClelland, Maier & Neustadt, L.L.P.

(57) ABSTRACT

According to an embodiment, a gas-blast circuit breaker comprises a heat removal unit in a flow path of arc extinguishing gas. The heat removal unit each includes: plate-shaped heat removal members contacting the arc extinguishing gas flowing in the flow path; and a holding portion holding the plate-shaped heat removal members to stack the heat removal members at intervals in a thickness direction. Each of the heat removal members includes: an upstream side end portion; a downstream side end portion; and a thickest portion with a largest thickness which is provided between the upstream side end portion and the downstream side end portion. Thickness of the heat removal member continuously changes between the upstream side end portion and the downstream side end portion via the thickest portion.

9 Claims, 13 Drawing Sheets

(56) References Cited

U.S. PATENT DOCUMENTS

| | | | | |
|---|---|---|---|---|
| 2003/0201853 | A1* | 10/2003 | Charles | H01H 1/2058 335/16 |
| 2007/0221626 | A1* | 9/2007 | Uchii | H01H 33/56 218/57 |
| 2008/0277382 | A1* | 11/2008 | Chen | H01H 9/36 218/151 |
| 2011/0236002 | A1* | 9/2011 | Oglesby | A61M 15/06 392/386 |
| 2013/0056444 | A1* | 3/2013 | Cernat | H01H 33/91 218/51 |
| 2014/0360982 | A1* | 12/2014 | Gerving | H01H 9/443 218/24 |
| 2016/0307716 | A1* | 10/2016 | Florez | H01H 33/22 |
| 2017/0345593 | A1* | 11/2017 | Nakai | H01H 33/08 |

* cited by examiner

FIG. 17

| | Shape of Cross-Section | Length [mm] | Thick-ness [mm] | Gap [mm] | Number of Levels | Flow Velocity [m/s] | Arrange-ment |
|---|---|---|---|---|---|---|---|
| Example A | Streamline | 10 | 1 | 1 | 2 | 5 | Square |
| Example B | Rhombus | 10 | 1 | 1 | 2 | 5 | Square |
| Example C | Oval | 10 | 1 | 1 | 2 | 5 | Square |
| Example E | Streamline | 10 | 1 | 1 | 1 | 5 | - |
| Example F | Streamline | 10 | 1 | 1 | 5 | 5 | Square |
| Example G | Streamline | 10 | 1 | 1 | 1 | 50 | - |
| Example H | Streamline | 10 | 1 | 1 | 2 | 50 | Square |
| Example J | Streamline | 10 | 1 | 1 | 5 | 50 | Square |
| Example K | Streamline | 10 | 1 | 1 | 2 | 5 | Zigzag |
| Example M | Streamline | 10 | 1 | 1 | 5 | 5 | Zigzag |
| Example N | Streamline | 10 | 1 | 2 | 2 | 5 | Square |
| Example Q | Streamline | 10 | 1 | 4 | 2 | 5 | Square |
| Example R | Streamline | 1.5 | 1 | 1 | 1 | 50 | - |
| Example S | Streamline | 2 | 1 | 1 | 1 | 50 | - |
| Example T | Streamline | 3 | 1 | 1 | 1 | 50 | - |
| Example U | Streamline | 4 | 1 | 1 | 1 | 50 | - |
| Example W | Streamline | 5 | 1 | 1 | 1 | 50 | - |
| Comparative Example D | Rectangular | 10 | 1 | 1 | 2 | 5 | Square |

GAS-BLAST CIRCUIT BREAKER

CROSS REFERENCE TO RELATED APPLICATION

This application is based upon and claims the benefit of priority from Japanese Patent Application No. 2018-052935, filed Mar. 20, 2018; the entire content of which is incorporated herein by reference.

FIELD

The embodiment of the present invention is related to a gas-blast circuit breaker.

BACKGROUND

Conventionally, a gas-blast circuit breaker has a function to extinguish an arc by spraying arc extinguishing gas such as $SF_6$ gas to the arc generated between electrodes when an electric circuit is cut off. Since insulation performance of the arc extinguishing gas is generally reduced at a high temperature, heat removal is necessary after the arc extinguish gas is heated in spraying to the arc.

Thus, the gas-blast circuit breaker of this type has a cooling cylinder, for example, constituting a flow path for heat removal of the arc extinguishing gas on a downstream side between the above-described electrodes. Here, in a situation that heat removal performance by the cooling cylinder is insufficient, resulting in reduction of the insulation performance of the arc extinguishing gas, there is a possibility that dielectric breakdown occurs between a tank of ground potential which is a casing of the gas-blast circuit breaker and the cooling cylinder of high voltage which is housed in this tank. In consideration of the problem of dielectric breakdown as above, a comparatively large space is secured in the gas-blast circuit breaker in order to give a certain or more interval between the tank and the cooling cylinder.

On the other hand, in order to reduce a disposition space for disposing a main body of the gas-blast circuit breaker or to curtail material costs of components of the gas-blast circuit breaker, downsizing of the gas-blast circuit breaker is demanded. In downsizing the gas-blast circuit breaker, considering the above-described problem of dielectric breakdown, it is important to improve the heat removal performance to the arc extinguishing gas. Further, regarding a configuration for improving the heat removal performance, it is required to consider a pressure loss of the arc extinguishing gas flowing in the flow path such as the cooling cylinder.

BRIEF DESCRIPTION OF THE DRAWINGS

FIG. 17 is a table of configurations of examples and comparative examples

DETAILED DESCRIPTION

An object of embodiments of the present invention is to provide a gas-blast circuit breaker capable of enhancing heat removal performance to arc extinguishing gas while suppressing a pressure loss of the arc extinguishing gas flowing in a flow path.

According to an embodiment, there is provided a gas-blast circuit breaker comprising at least one heat removal unit disposed in a flow path of arc extinguishing gas, wherein the at least one heat removal unit each includes: a plurality of plate-shaped heat removal members each contacting the arc extinguishing gas flowing in the flow path to perform heat removal to the arc extinguishing gas; and a holding portion holding the plurality of plate-shaped heat removal members in a manner to stack the plurality of plate-shaped heat removal members at intervals with each other in a thickness direction, wherein each of the heat removal members includes: an upstream side end portion provided on an upstream side in a flow direction of the arc extinguishing gas; a downstream side end portion provided on a downstream side in the flow direction; and a thickest portion with a largest thickness which is provided between the upstream side end portion and the downstream side end portion, wherein a thickness of the heat removal member continuously changes between the upstream side end portion and the downstream side end portion via the thickest portion.

Hereinafter, embodiments will be described based on the drawings.

Figure 1:
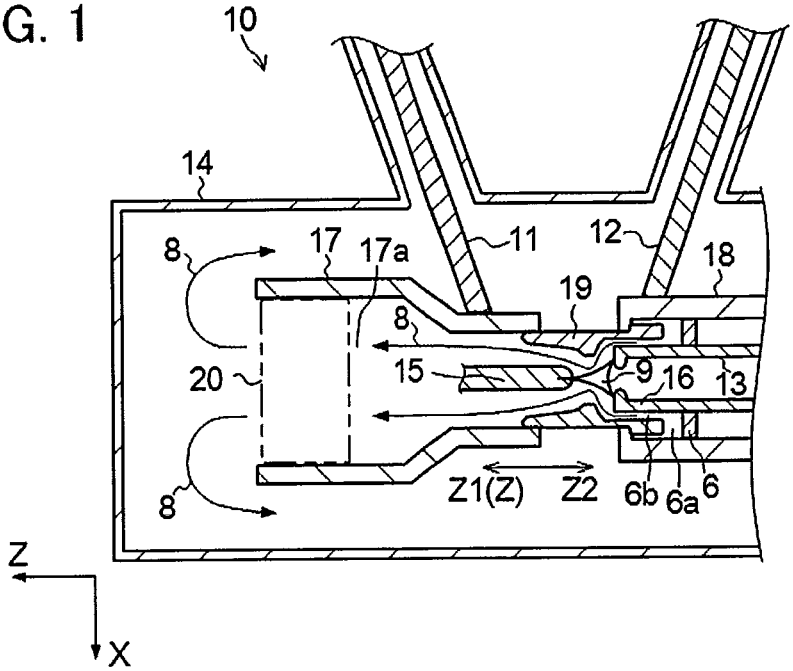
FIG. 1 is a cross-sectional view schematically illustrating a gas-blast circuit breaker according to an embodiment.

As illustrated in FIG. 1, a gas-blast circuit breaker 10 of this embodiment mainly has a tank 14, a cooling cylinder 17, a fixed electrode 15, a movable electrode 16, an insulating nozzle 19, an operation rod 13, a puffer piston 6, a puffer cylinder 18, and a heat removal unit 20.

The tank 14 is a casing of the gas-blast circuit breaker 10 and filled with arc extinguishing gas 8 such as $SF_6$ thereinside. The cooling cylinder 17 and the puffer cylinder 18 are connected with conductors 11, 12 which are extended from the inside of two bushings, respectively. These cooling cylinder 17 and puffer cylinder 18 have high potential, while the tank 14 has ground potential.

The fixed electrode 15 and the movable electrode 16 are disposed to face each other. The movable electrode 16 is configured to be able to be inserted into and pulled from (be able to contact and be separated from) the fixed electrode in an axial direction of both (in an arrow Z1-Z2 direction). The movable electrode 16, the operation rod 13, and the insulating nozzle 19 are each disposed coaxially to the puffer cylinder 18. The operation rod 13 is configured to have a pipe shape and is fixed to an axial center portion of the puffer cylinder 18. The movable electrode 16 is provided in a tip portion of the operation rod 13. The insulating nozzle 19, the operation rod 13, and the puffer cylinder 18, together with the movable electrode 16, integrally move forward and backward in relation to the fixed electrode 15.

More specifically, as illustrated in FIG. 1, in relation to the fixed electrode 15, the movable electrode 16 moves forward in the arrow Z1 direction when the electrodes are to be closed (when current is supplied) to thereby make an inside portion of a main body of the movable electrode 16 come in contact with an outer peripheral portion of the fixed electrode 15. Meanwhile, when the electrodes are to be opened (when current is interrupted), the movable electrode 16 moves backward from the fixed electrode 15 in the arrow Z2 direction to thereby make the inside portion of the main body of the movable electrode 16 apart from the outer peripheral portion of the fixed electrode 15.

The insulating nozzle 19 is disposed coaxially to the movable electrode 16 and the fixed electrode 15. The insulating nozzle 19 is a nozzle to spray arc extinguishing gas 8 to an arc generated between the movable electrode 16 and the fixed electrode 15 when the electrodes are to be opened.

Further, the puffer piston 6 is inserted in a slidable manner between an inner wall portion inside the puffer cylinder 18 and an outer peripheral portion of the operation rod 13. Further, a space surrounded by a front surface portion of the puffer piston 6 and the inner wall portion of the puffer cylinder 18 forms a puffer chamber 6*a*. Besides, between the movable electrode 16 in the tip portion of the puffer cylinder 18 and the insulating nozzle 19, there is provided an opening portion 6*b* to introduce the arc extinguishing gas 8 having been compressed inside the puffer chamber 6*a* toward an arc 9 generated between the fixed electrode 15 and the movable electrode 16 when the electrodes are to be opened, in cooperation with the insulating nozzle 19.

In other words, in a closed electrode state (power supplied state), when the operation rod 13 is operated to open the electrodes via a predetermined operation mechanism, the movable electrode 16 in the tip portion of the operation rod 13 is moved in the arrow Z2 direction, making the movable electrode 16 and the fixed electrode 15 apart from each other. On this occasion, the arc 9 is generated between the movable electrode 16 and the fixed electrode 15. Movement of the puffer cylinder 18 in the arrow Z2 direction which is parallel to the above actions reduce volume of the puffer chamber 6*a* formed between the puffer piston 6 and the puffer cylinder 18. Thereby, the arc extinguishing gas 8 compressed inside the puffer chamber 6*a* is sprayed from the opening portion 6*b* to a space between the fixed electrode 15 and the movable electrode 16 via the insulating nozzle 19. Consequently, the arc 9 is cooled rapidly.

Next, a configuration of the cooling cylinder 17 will be described. The cooling cylinder 17 is formed to have a hollow cylindrical shape for example, and a flow path 17*a* for removing heat from the arc extinguishing gas 8 is constituted by holes inside a main body of the cooling cylinder 17, as illustrated in FIG. 1. The cooling cylinder 17 is provided on a downstream side of contact points between the moving electrode 16 and the fixed electrode 15 in a flow direction (arrow Z direction) of the arc extinguishing gas 8. Regarding the cooling cylinder 17, in the flow direction of the arc extinguishing gas 8, a portion on the upstream side is configured to have a comparatively small diameter while a portion on the downstream side is configured to have a larger diameter than that of the portion on the upstream side, for example. An intermediate portion between the portion on the upstream side and the portion on the downstream side in the cooling cylinder 17 is configured so that its diameter is gradually enlarged toward the downstream side. Further, the arc extinguishing gas 8 flowing out of an opening portion at a most downstream end in the cooling cylinder 17 is returned to the above-described puffer chamber 6*a* through a predetermined circulation flow path provided in the tank 14, for example.

Here, since the insulation performance of the arc extinguishing gas 8 is deteriorated at a high temperature, it is necessary to remove heat after the arc extinguishing gas 8 is heated in spraying to the arc 9. In a status that the insulation performance of the arc extinguishing gas 8 is deteriorated, dielectric breakdown or the like may occur between the tank 14 of ground potential and the cooling cylinder 17 of high voltage which is housed in the tank 14. Therefore, heat removal of the arc extinguishing gas 8 inside the cooling cylinder 17 is important.

Figure 2:
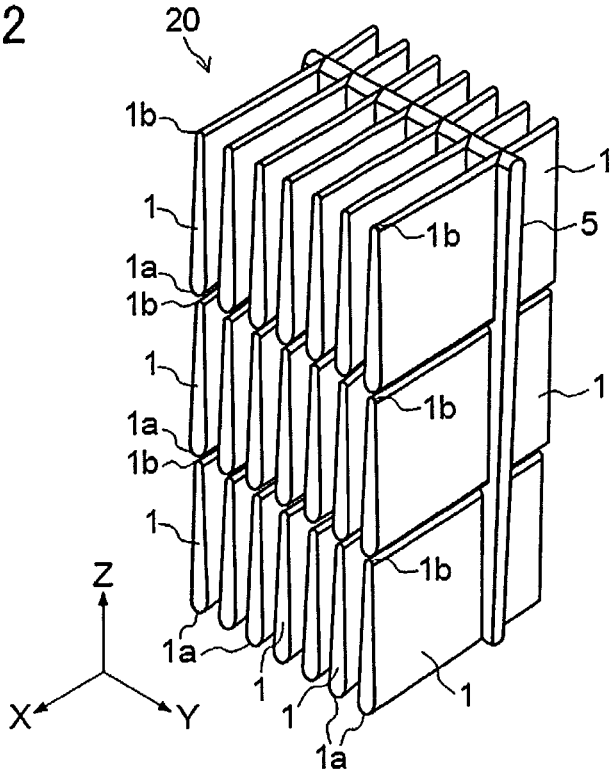
FIG. 2 is a perspective view illustrating external appearance of a heat removal unit housed in the gas-blast circuit breaker of FIG. 1.

Thus, the gas-blast circuit breaker 10 of this embodiment is provided with the above-described heat removal unit 20 in the flow path of the arc extinguishing gas 8 in the cooling cylinder 17, as illustrated in FIG. 1 and FIG. 2. When the gas-blast circuit breaker 10 is intended to be downsized, for example, considering the aforementioned problem of dielectric breakdown, it is important to further improve the heat removal performance to the arc extinguishing gas 8. In the heat removal unit 20, in addition to improvement of the heat removal performance to the arc extinguishing gas 8, a pressure loss of the arc extinguishing gas 8 is also taken into consideration.

Next, a structure of the heat removal unit 20 will be described in detail. As illustrated in FIG. 2, the heat removal unit 20 is a three-dimensional mesh-like structure which has a plurality of plate-shaped heat removal members and a holding portion. As a material of the heat removal unit 20, tungsten or the like is used. The heat removal unit 20 is manufactured by an AM (Additive Manufacturing) technology to which a metal 3D printer or the like is applied, for example.

The plurality of plate-shaped heat removal members 1 each contact the arc extinguishing gas 8 flowing in the flow path 17*a* inside the cooling cylinder 17 to thereby perform heat removal to the arc extinguishing gas 8. The holding portion 5 holds the plurality of plate-shaped heat removal members 1 in a manner to stack them while keeping intervals in a thickness direction (arrow Y direction) between them. An end surface of the holding portion 5 is joined to an inner wall portion of the cooling cylinder 17, for example. In FIG. 1, there is illustrated an example that, inside the cooling cylinder 17, the heat removal unit 20 illustrated in FIG. 2 is disposed in a manner that a depth direction (arrow X direction) of the heat removal member 1 in the heat removal unit 20 is oriented in a vertical direction of the gas-blast circuit breaker 10. In place of the above, the heat removal unit 20 may be disposed inside the cooling cylinder 17 in a manner that the thickness direction (arrow Y direction) of the heat removal member 1 in the heat removal unit 20 is oriented in the vertical direction of the gas-blast circuit breaker 10 (tank 14).

Figure 3:
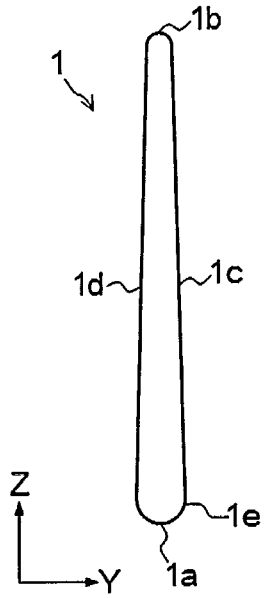
FIG. 3 is a cross-sectional view illustrating a streamlined heat removal member provided in the heat removal unit of FIG. 2.

As illustrated in FIG. 2 and FIG. 3, each of the heat removal members 1 has an upstream side end portion 1*a* and a downstream side end portion 1*b*, as well as a thickest portion 1*e*. The upstream side end portion 1*a* is a most upstream end provided on the upstream side in a flow direction (arrow Z direction) of arc extinguishing gas in the main body of the heat removal member 1. On the other hand, the downstream side end portion 1*b* is a most downstream end provided on the downstream side of the flow direction (arrow Z direction) of the arc extinguishing gas in the main body of the heat removal member 1. The thickest portion 1*e* is a portion of largest thickness which is provided between the upstream side end portion 1*a* and the downstream side end portion 1*b*.

More specifically, the thickest portion 1*e* is provided between the upstream side end portion 1*a* and a center portion of the upstream side end portion 1*a* and the downstream side end portion 1*b*. Further, a thickness of the heat removal member 1 continuously changes between the upstream side end portion 1*a* and the downstream side end portion 1*b* via the thickest portion 1*e* (between the upstream side end portion 1*a* and the thickest portion 1*e*, and between the thickest portion 1*e* and the downstream side end portion 1*b*). Surfaces 1*c*, 1*d* of a portion in which the thickness continuously changes in the heat removal member 1 are constituted by curved surfaces and inclined surfaces. The thickest portion 1*e* is a portion with the largest thickness which is provided between the upstream side end portion 1*a* and the center portion of the upstream side end portion 1*a* and the downstream side end portion 1*b*.

In the examples illustrated in FIG. 2 and FIG. 3, a cross-sectional shape of the heat removal member 1 is streamlined in the case where the heat removal member 1 is cut along its thickness direction. Here, as illustrated in FIG. 2 and FIG. 3, the streamlined shape means a shape in which the upstream side end portion 1*a* is constituted by the curved surface and which is tapered from the upstream side end portion 1*a* toward the downstream side end portion 1*b* via the thickest portion 1*e*. Note that the heat removal member 1, when viewed along its thickness direction (arrow Y direction), has a rectangular shape which has short edges in the above-described flow direction (arrow Z direction) and long edges in the depth direction (arrow X direction). Further, a length in the above-described flow direction in the heat removal member is desirable to be twice or more the thickness of the thickest portion 1*e*. This configuration enables effective cooling of the high-temperature arc extinguishing gas 8 having flowed into the heat removal unit 20.

Further, in the heat removal unit 20 of FIG. 2, there is illustrated an example in which the holding portion 5 holds the plurality of plate-shaped heat removal members 1 in a status that the heat removal members 1 are arranged in two or more levels (three levels in the example of FIG. 2) in the flow direction (arrow Z direction) of the arc extinguishing gas 8. In place of the above, it is possible to configure a heat removal unit in which a holding portion 5 holds a plurality of plate-shaped heat removal members 1 in only one level in a flow direction (arrow Z direction) of arc extinguishing gas 8.

Figure 4:
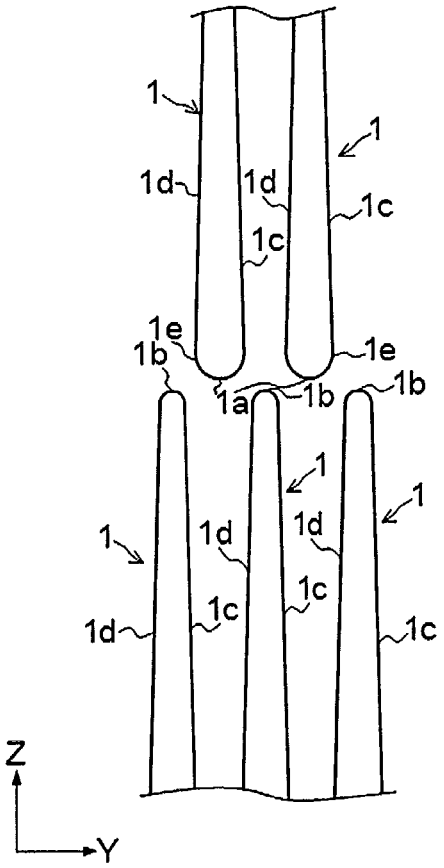
FIG. 4 is a cross-sectional view illustrating an example in which the heat removal members of FIG. 3 are shifted each other in a thickness direction when disposed.

Further, in the heat removal unit 20 of FIG. 2, there is illustrated the example in which the heat removal members 1 adjacent to each other in the flow direction (arrow Z direction) of the arc extinguishing gas 8 which are arranged in two or more levels are disposed in a manner that respective positions in the thickness direction (arrow Y direction) are in line. In place of the above, as illustrated in FIG. 4, a heat removal unit may be applied in which heat removal members 1 adjacent to each other in a flow direction (arrow Z direction) of arc extinguishing gas 8 are disposed in a manner that respective positions in a thickness direction (arrow Y direction) are shifted (offset) (disposed in a zigzag alignment).

It is also possible to constitute the aforementioned heat removal members 1 adjacent to each other in the flow direction (arrow Z direction) of the arc extinguishing gas 8 which are arranged in two or more levels by different materials from each other. In other words, a material of high melting point such as tungsten may be applied to the heat removal member of the first level from an upstream side where arc extinguishing gas 8 of comparatively high temperature comes into contact, and a material of lower melting point and high heat conduction such as copper may be applied to the heat removal member of the second or later levels where the arc extinguishing gas 8 having a lower temperature due to heat removal by the heat removal members of the first level is introduced. Further, when heat removal members are arranged in multiple levels of two or more, heat removal members of different cross-sectional shapes may be disposed for different levels.

In other words, examples of the heat removal member with different cross-sectional shapes include later-described heat removal members having rhombic and elliptic cross-sectional shapes. Further, in the case of arranging heat removal members in multiple levels of two or more, it is also possible to configure a heat removal unit in which a shape parameter such as a gap between the heat removal members is changed for each level.

Figure 5:
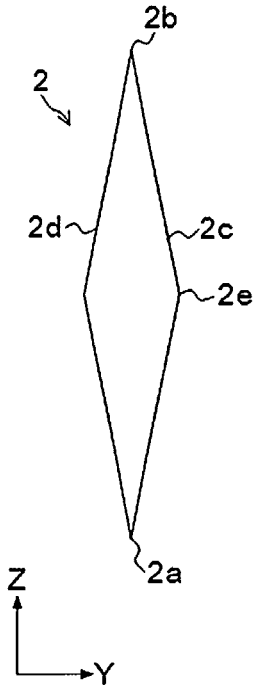
FIG. 5 is a cross-sectional view illustrating a rhombic heat removal member.
Figure 6:
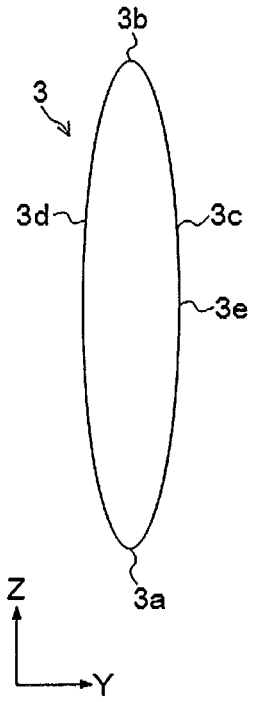
FIG. 6 is a cross-sectional view illustrating an elliptic heat removal member.

Further, in the examples illustrated in FIG. 2 and FIG. 3, the cross-sectional shapes in the case where the heat removal member 1 is cut along its thickness direction are streamlined, but instead, it is possible to configure a heat removal unit using heat removal members 2 whose cross-sectional shape is rhombic or heat removal members 3 whose cross-sectional shape is elliptic as illustrated in FIG. 5 and FIG. 6.

As illustrated in FIG. 5, the elliptic heat removal member 2 has an upstream side end portion 2*a* and a downstream side end portion 2*b*, as well as a thickest portion 2*e*. The thickest portion 2*e* is provided between the upstream side end portion 2*a* and a center portion of the upstream side end portion 2*a* and the downstream side end portion 2*b*. The thickest portion 2*e* may be unevenly arranged in an upstream side end portion 2*a* direction or a downstream side end portion 2*b* direction when viewed from the above-described center portion. Surfaces 2*c*, 2*d* of a portion in which a thickness continuously changes in the heat removal member 2 can be constituted by inclined surfaces or curved surfaces, for example.

Meanwhile, as illustrated in FIG. 6, the elliptic heat removal member 3 has an upstream side end portion 3*a* and a downstream side end portion 3*b*, as well as a thickest portion 3*e*. The upstream side end portion 3*a* and the downstream side end portion 3*b* are constituted by curved surfaces. The thickest portion 3*e* is provided between the upstream side end portion 3*a* and a center portion of the upstream side end portion 3*a* and the downstream side end portion 3*b*. Surfaces 3*c*, 3*d* of a portion in which a thickness continuously changes in the heat removal member 3 are constituted by curved surfaces.

Figure 7:
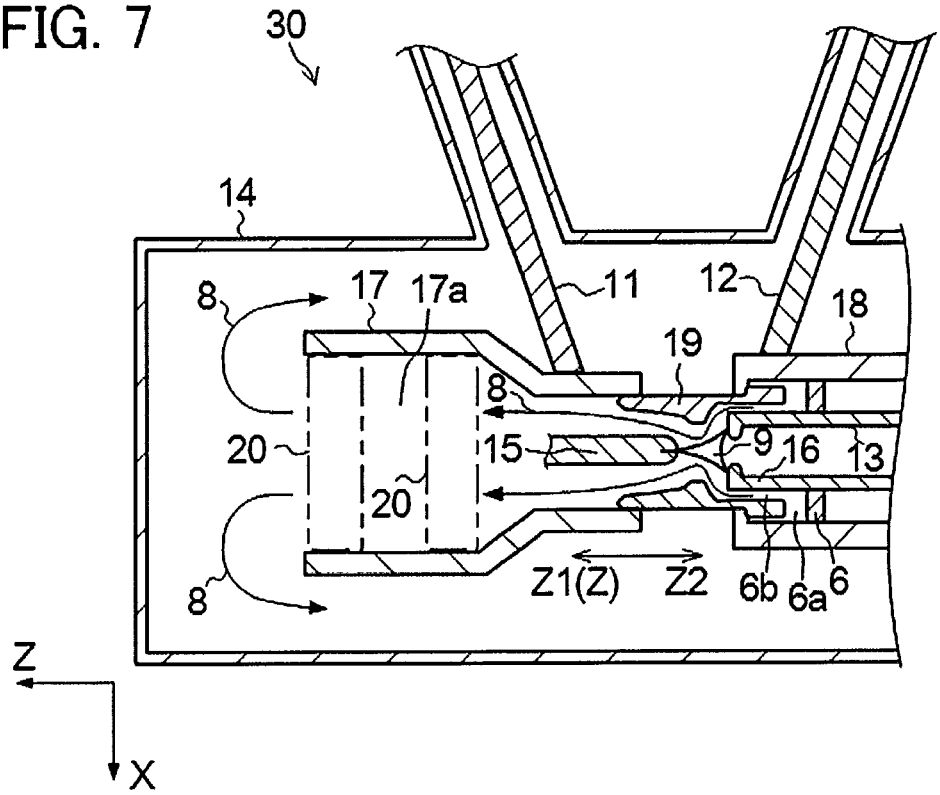
FIG. 7 is a cross-sectional view illustrating an example in which two heat removal units are disposed in the gas-blast circuit breaker of FIG. 1.

Further, as illustrated in FIG. 7, it is possible to configure a gas-blast circuit breaker 30 in which two or more heat removal units 20 are in line inside a flow path 17*a* of a cooling cylinder 17 along a flow direction of arc extinguishing gas 8. The two or more heat removal units provided in this case are different in disposition place in the flow direction. Here, in the heat removal unit 20, narrowing the gap in the thickness direction (arrow Y direction) between the heat removal members increases a pressure loss when the arc extinguishing gas 8 flows, but also increases a cooling effect (heat removal effect). Therefore, regarding the heat removal unit which is mounted on a neighborhood of an upstream side of the cooling cylinder 17 into which comparatively high-temperature arc extinguishing gas 8 flows at a high velocity in the flow direction (arrow Z direction) of the arc extinguishing gas 8, the gap in the thickness direction between heat removal members may be made large in order to give priority to rectification. On the other hand, regarding the heat removal unit mounted on a neighborhood of an opening portion of a downstream side end where the flow path 17*a* of the cooling cylinder 17 is broadened and a flow velocity of the arc extinguishing gas 8 is decreased, it is exemplified to narrow the gap in the thickness direction between the heat removal members in order to give priority to the cooling (heat removal) effect.

Further, as a composing material of the entire heat removal unit 20, it is desirable to use a material such as tungsten, for example, whose melting point is higher than a temperature of arc extinguishing gas 8 flowing in the flow path 17*a* of the cooling cylinder 17 and which has non-responsiveness (does not chemically react) to the arc extinguishing gas 8. Further, in the case where $SF_6$ gas is used as the arc extinguishing gas 8 as described above, it is also possible to use iron (stainless steel or the like) which is low in cost and which has non-responsiveness to the $SF_6$ gas as the composing material of the heat removal unit. On the other hand, regarding aluminum which causes exoergic reaction with $SF_4$ gas which may be generated after dissociation by an arc, it is desirable not to be used as a composing material of the heat removal unit. Here, though $SF_6$ gas was exemplified as the arc extinguishing gas, it is possible to apply other arc extinguishing gas such as carbon dioxide ($CO_2$). In the case of using carbon dioxide or mixed gas whose major constituent is carbon dioxide as the arc extinguishing gas, it is possible to use a nickel material having non-reactivity to carbon dioxide, as a material of the heat removal unit.

As described above, in the gas-blast circuit breakers 10, 30 of this embodiment, in the process where the arc extinguishing gas 8 passes through the heat removal unit 20 inside the cooling cylinder 17, respective portions of the plate-shaped heat removal members stacked with intervals (the upstream side end portions or surfaces opposed to each other in the thickness direction of the heat removal members) closely contact the arc extinguishing gas 8, resulting in effective cooling. Further, in the gas-blast circuit breakers 10, 30, since the heat removal members are configured to be streamlined or the like in shape, it is possible to enhance the heat removal performance to the arc extinguishing gas 8 while suppressing the pressure loss of the arc extinguishing gas 8 flowing in the flow path 17*a* of the cooling cylinder 17. Further, in the gas-blast circuit breakers 10, 30, improvement of the heat removal performance to the arc extinguishing gas 8 secures insulation performance of the arc extinguishing gas 8, reducing a possibility of occurrence of dielectric breakdown, whereby it becomes possible to downsize the gas-blast circuit breaker main body.

Examples

Figure 8:
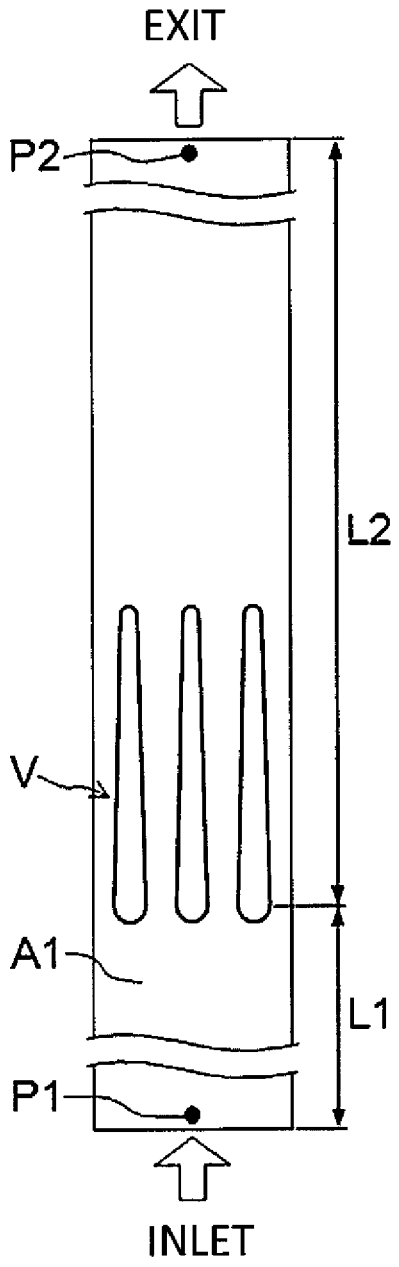
FIG. 8 is a view for explaining an analysis condition of the heat removal unit.

Next, Examples will be described based on FIG. 8 to FIG. 16, in addition to FIG. 1 to FIG. 7 described above. As illustrated in FIG. 8, to an analysis method of the Example, an evaluation method by software using an analysis model (computational fluid dynamics (CFD) simulation) was applied. Analysis conditions are as listed below (see FIG. 8 and FIG. 9).

Figure 9:
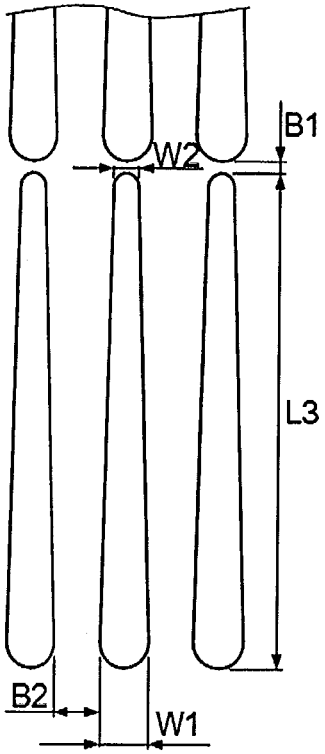
FIG. 9 is a view for explaining a dimension of each portion of the heat removal unit.

<Analysis Method, Analysis Model>
Used software: STAR-CCM+v11.06
Two-dimensional model
Implicit method transient analysis (time step: 0.1 ms, maximum physical time: 100 ms)
<Boundary Condition>
Entrance end of lower surface of fluid region A1: entrance velocities (5 m/s and 50 m/s)
Exit end of upper surface of fluid region A1: exit pressure (0 Pa)
Side surface of fluid region A1: symmetry planes
<Initial Condition>
Temperature: 300 K in whole region
<Monitoring Points>
Entrance monitoring point P1 and exit monitoring point P2 are set at positions 1 mm inside entrance end and exit end, respectively.
<Other Conditions>
Distance L1 from entrance end to thickest portion of model V of heat removal member: 20 mm
Distance L2 from thickest portion of model V of heat removal member to exit end portion: 150 mm As illustrated in FIG. 9, regarding a gap B1 in a flow path direction of the heat removal member in the case of disposition in two or more levels, the gap B1 was set to be 0.25 mm in common among streamlined, rhombic, and ellipse heat removal members of Examples and heat removal members of Comparative Example. Note that a downstream end (downstream thickness) W2 in the streamlined heat removal member was set to be 0.5 mm. Further, regarding a length L3 in a flow direction in the heat removal members of Examples and Comparative Example, a thickness W1 of the thickest portion, and a gap B2 in a thickness direction between the heat removal members, variables are to be input (set) appropriately.

Figure 10:
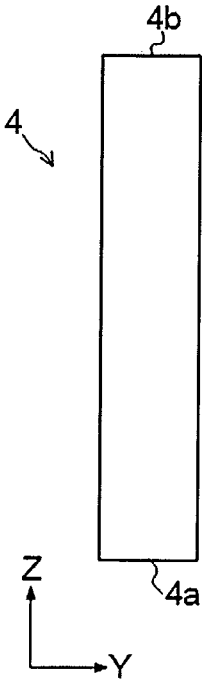
FIG. 10 is a cross-sectional view illustrating a rectangular heat removal member being a comparative example.

Further, as illustrated in FIG. 10, to the heat removal member of Comparative Example, a heat removal member 4 with a rectangular cross section was applied. The heat removal member 4 has an upstream side end portion 4*a* and a downstream side end portion 4*b*. Further, the heat removal member 4 is configured to have a uniform thickness in an arrow Y direction.

Here, Examples A, B, C, E, F, G, H, J, K, M, N, Q, R, S, T, U, W, and Comparative Example D which are evaluation objects have configurations listed in FIG. 17.

Here, zigzag in arrangement in Table 1 means a status that, as illustrated in FIG. 4, heat removal members adjacent to each other in a flow direction (arrow Z direction) of arc extinguishing gas 8 which are arranged in two or more levels are disposed with positions in thickness directions being shifted each other in a heat removal unit 20. On the other hand, square in arrangement in Table 1 means a status that, as illustrated in FIG. 9, heat removal members adjacent to each other in a flow direction of arc extinguishing gas 8 which are arranged in two or more levels are disposed with positions in thickness directions being lined up each other in a heat removal unit 20.

Further, regarding Examples and Comparative Example, a ratio [%] of decrease in temperature of fluid (arc extinguishing gas) as well as a pressure loss are obtained as evaluation results. More specifically, the ratio [%] of decrease in temperature can be obtained as a result of dividing a difference between an entrance temperature of the fluid at the entrance monitoring point P1 and the exit temperature of the fluid at an exit monitoring point P2 in FIG. 8 by the entrance temperature to find a percentage. The ratio [%] obtained by the above represents a heat removal effect. On the other hand, a pressure loss is a difference between an entrance pressure of the fluid at the entrance monitoring point P1 and an exit pressure of the fluid at the exit monitoring point P2. In the above-described CFD simulation, as a boundary condition, the exit pressure at the exit end of the upper surface of the fluid region A1 is set to be 0 (zero).

Figure 11A:
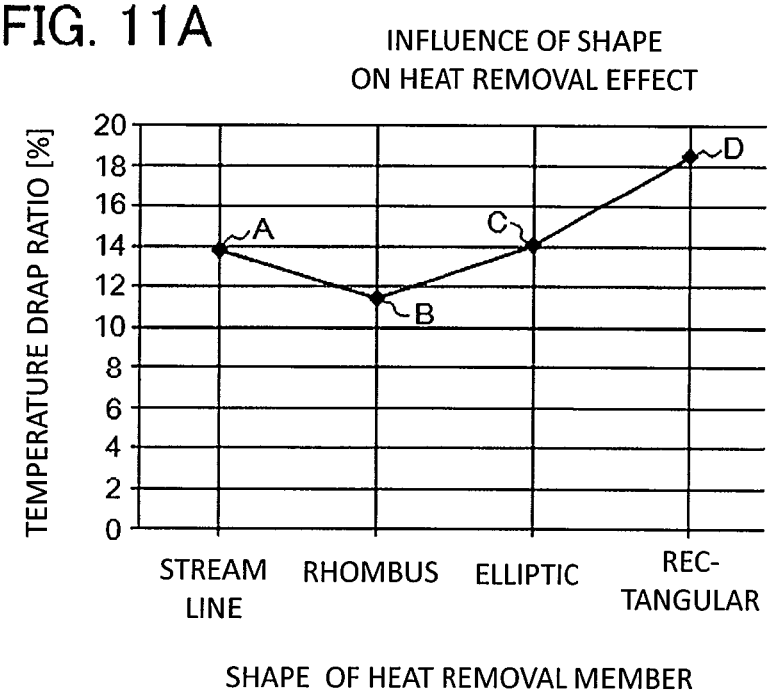
FIG. 11A is a graph illustrating influence of a shape of a heat removal member on a heat removal effect.
Figure 11B:
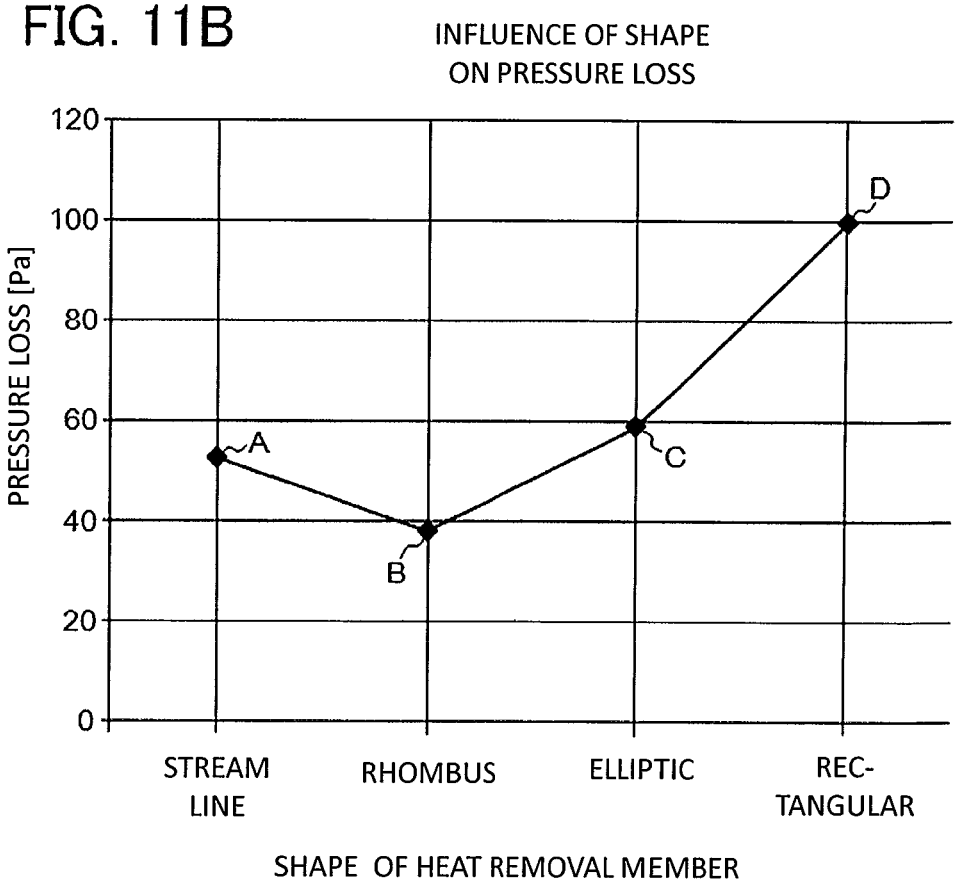
FIG. 11B is a graph illustrating influence of a shape of a heat removal member on a pressure loss.

FIG. 11A illustrates influence of a shape of a heat removal member on a heat removal effect as evaluation results of Examples A, B, C and Comparative Example D in Table 1 whose conditions other than a cross-sectional shape are the same. Meanwhile, FIG. 11B illustrates influence of the shape of the heat removal member on a pressure loss regarding Examples A, B, C and Comparative Example D. As described above, the larger ratio [%] of decrease in temperature which a vertical axis of FIG. 11A indicates means the higher heat removal effect by the heat removal member.

Though Comparative Example D whose cross-sectional shape is rectangular has a high heat removal effect (ratio) in the example illustrated in FIG. 11A, its pressure loss is also higher than those of Examples A, B, C in the example illustrated in FIG. 11B. It is found that, as the shape of the heat removal member, the streamlined shape of Example A and the elliptical shape of Example C which bring about comparatively high heat removal effects (ratios) and small pressure losses are preferable cross-sectional shapes.

Figure 12A:
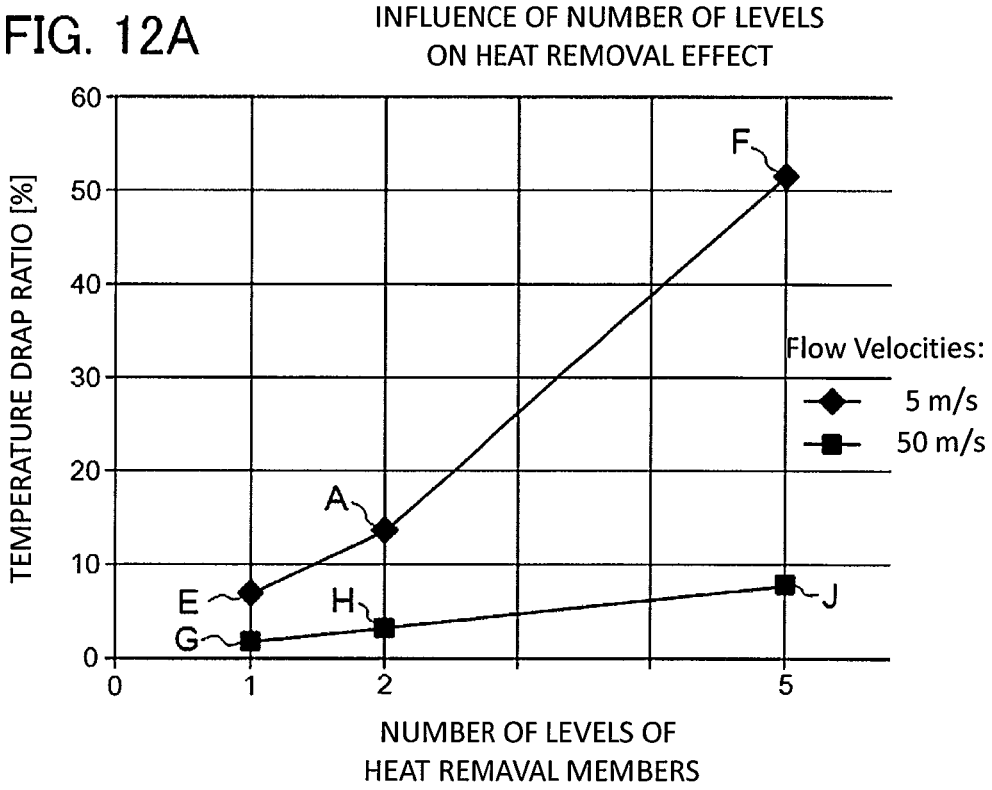
FIG. 12A is a graph illustrating influence of the number of levels of heat removal members on a heat removal effect.
Figure 12B:
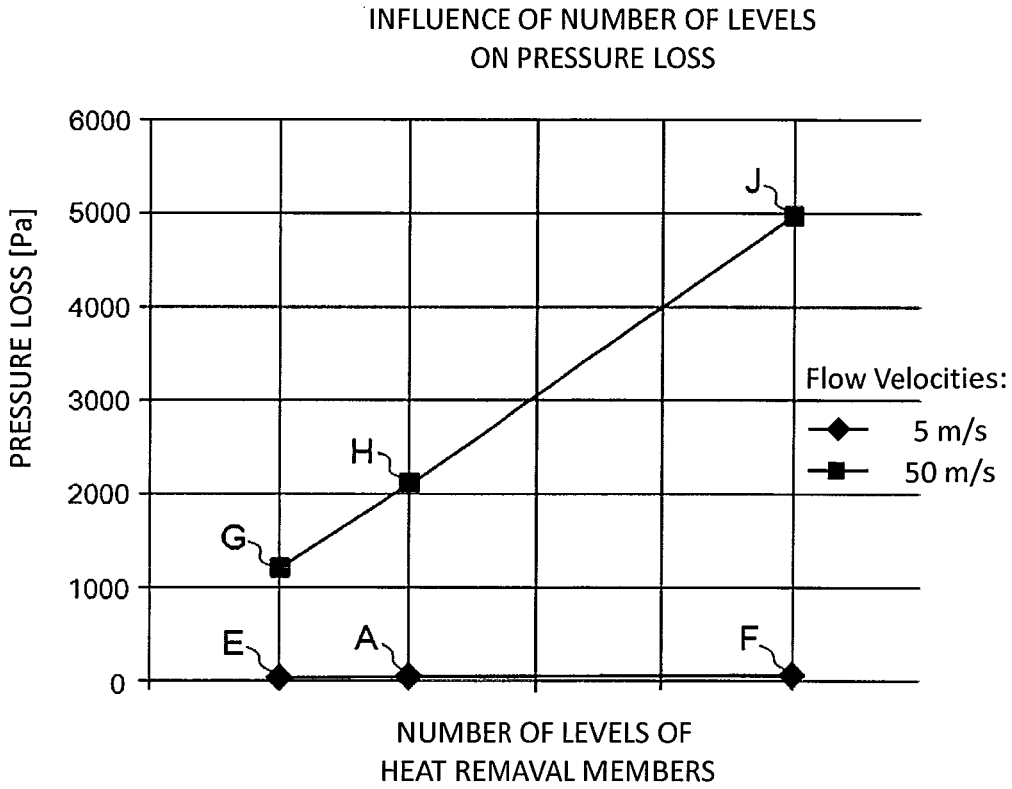
FIG. 12B is a graph illustrating influence of the number of levels of heat removal members on a pressure loss.

Further, FIG. 12A illustrates influence of the number of levels of heat removal members on a heat removal effect as evaluation results of Examples E, A, F and Examples G, H, J in Table 1 whose conditions other than the number of levels of the heat removal members are almost the same. Meanwhile, FIG. 12B illustrates influence of the number of levels of the heat removal members on a pressure loss regarding Examples E, A, F, G, H, J above. Compared with Examples A, H in which the number of levels is two, Examples F, J in which the number of levels is five are larger in volume of the heat removal members, so that an excellent heat removal effect (ratio) can be attained. Further, compared with Example J in which a flow velocity is 50 [m/s], Example F in which a flow velocity is 5 [m/s] can have a longer contact time with fluid (arc extinguishing gas), so that a larger heat removal ratio and a smaller pressure loss value can be obtained.

Therefore, under a circumstance where a velocity of fluid (arc extinguishing gas) is comparatively low, application of the heat removal unit with heat removal members stacked in about five levels, the number of levels larger than two, enables more improvement of heat removal performance to arc extinguishing gas while suppressing a pressure loss of the arc extinguishing gas.

Figure 13A:
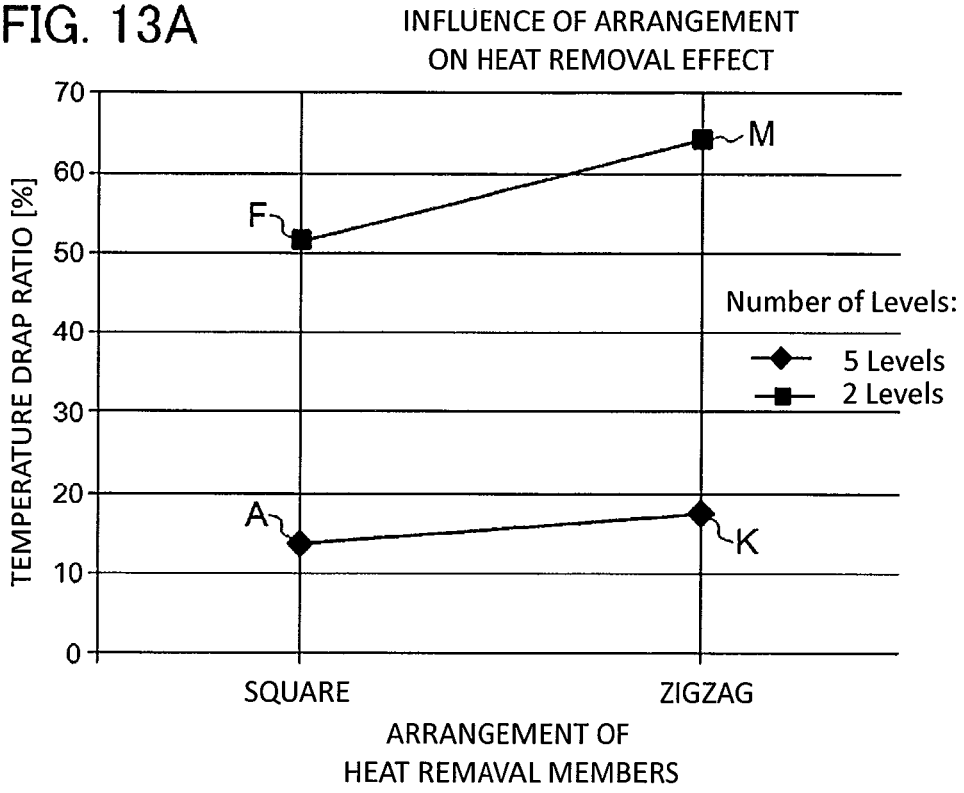
FIG. 13A is a graph illustrating influence of arrangement of heat removal members on a heat removal effect.
Figure 13B:
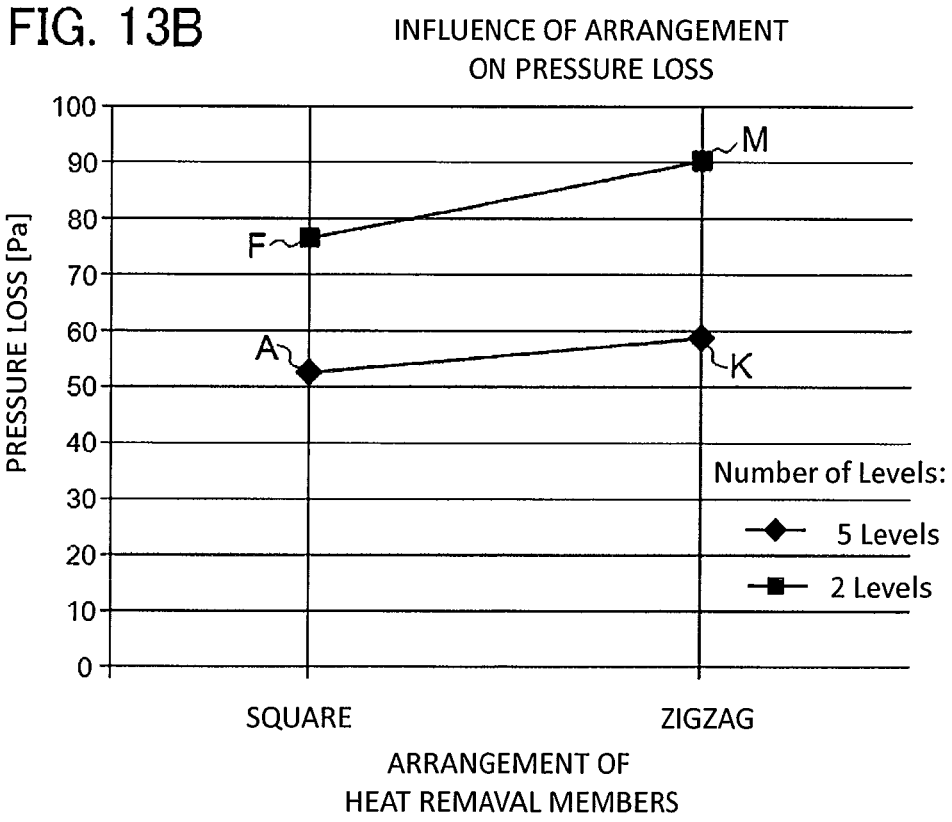
FIG. 13B is a graph illustrating influence of arrangement of heat removal members on a pressure loss.

Further, FIG. 13A illustrates influence of arrangement of heat removal members on a heat removal effect as evaluation results of Examples F, M and Examples A, K in Table 1 whose conditions other than the arrangement of the heat removal members are almost the same. Meanwhile, FIG. 13B illustrates influence of arrangement of heat removal members on a pressure loss regarding Examples F, M and Examples A, K above. Compared with Examples F, A of square arrangement, Examples F, J of zigzag arrangement attain higher heat removal effects though pressure losses thereof are slightly larger. As illustrated in FIG. 4, in the case of zigzag arrangement, layout is such that an axis center of the heat removal member of a downstream side level is disposed on an extension line of a gap between the heat removal members of an upstream side level, to thereby make contact between surfaces of the individual heat removal members and arc extinguishing gas closer, so that a good heat removal effect can be obtained.

Figure 14A:
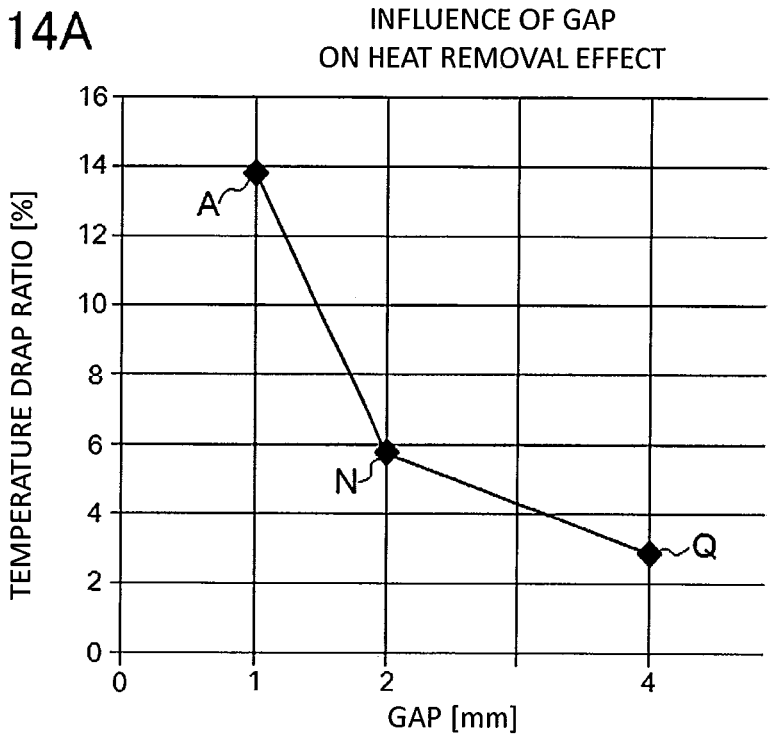
FIG. 14A is a graph illustrating influence of a gap in a thickness direction between heat removal members on a heat removal effect.
Figure 14B:
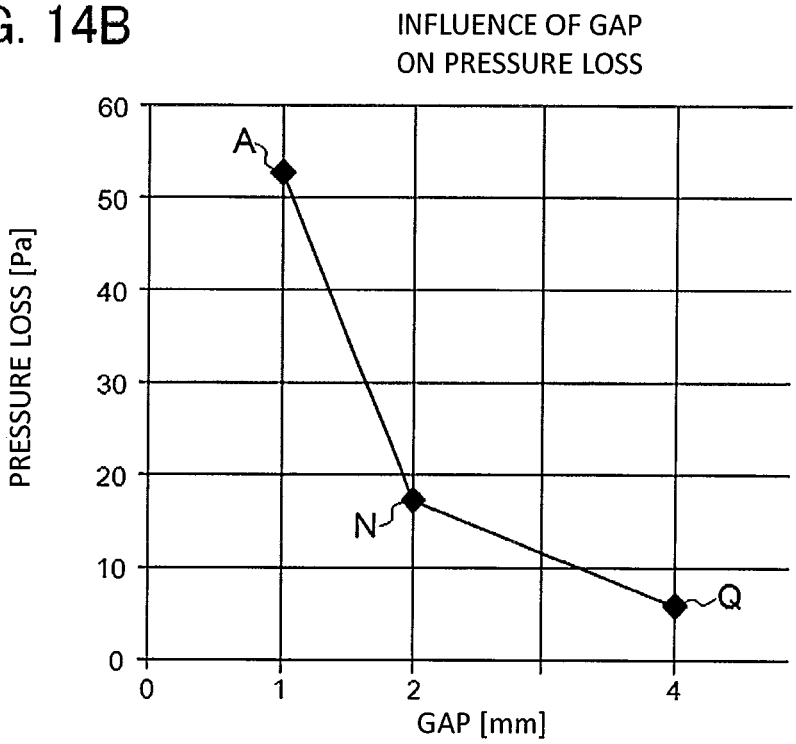
FIG. 14B is a graph illustrating influence of a gap in a thickness direction between heat removal members on a pressure loss.

FIG. 14A illustrates influence of a gap in a thickness direction between heat removal members on a heat removal effect as evaluation results of Examples A, N, Q in Table 1 whose conditions other than a gap B2 between the heat removal members exemplified in FIG. 9 are the same. Meanwhile, FIG. 14B illustrates influence of the gap between the heat removal members on a pressure loss regarding Examples A, N, Q above. Although narrowing the gap improves the heat removal effect, the pressure loss also increases thereby. Therefore, it is desirable to seek to improve the heat removal effect by setting a proper gap while securing an allowable pressure loss.

Figure 15A:
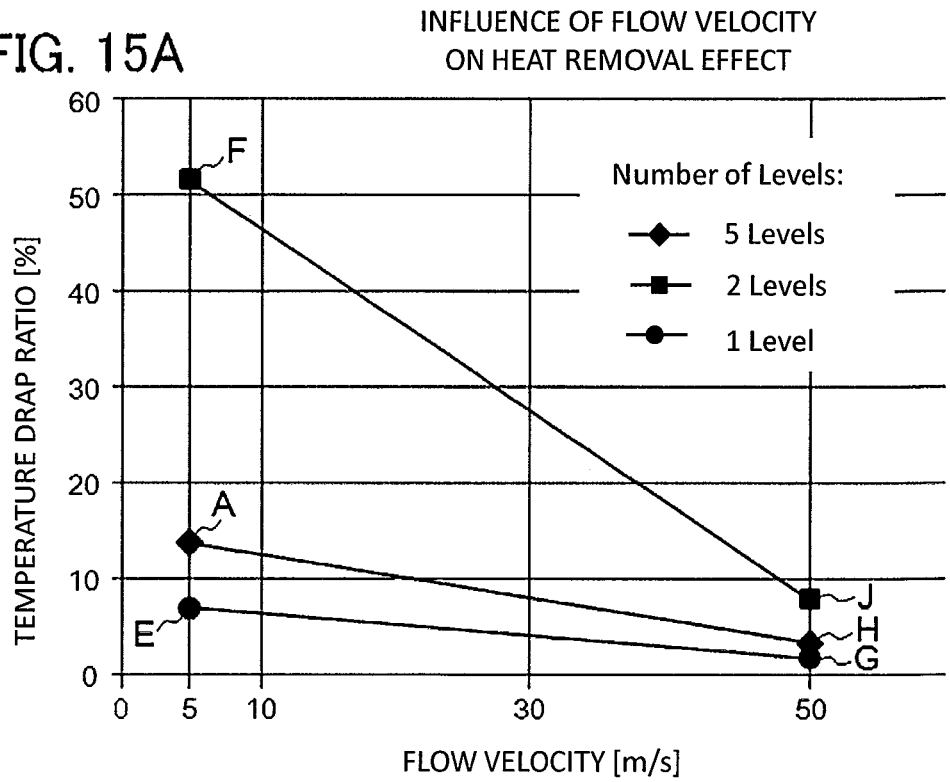
FIG. 15A is a graph illustrating influence of a flow velocity of arc extinguishing gas passing through a heat removal unit on a heat removal effect.
Figure 15B:
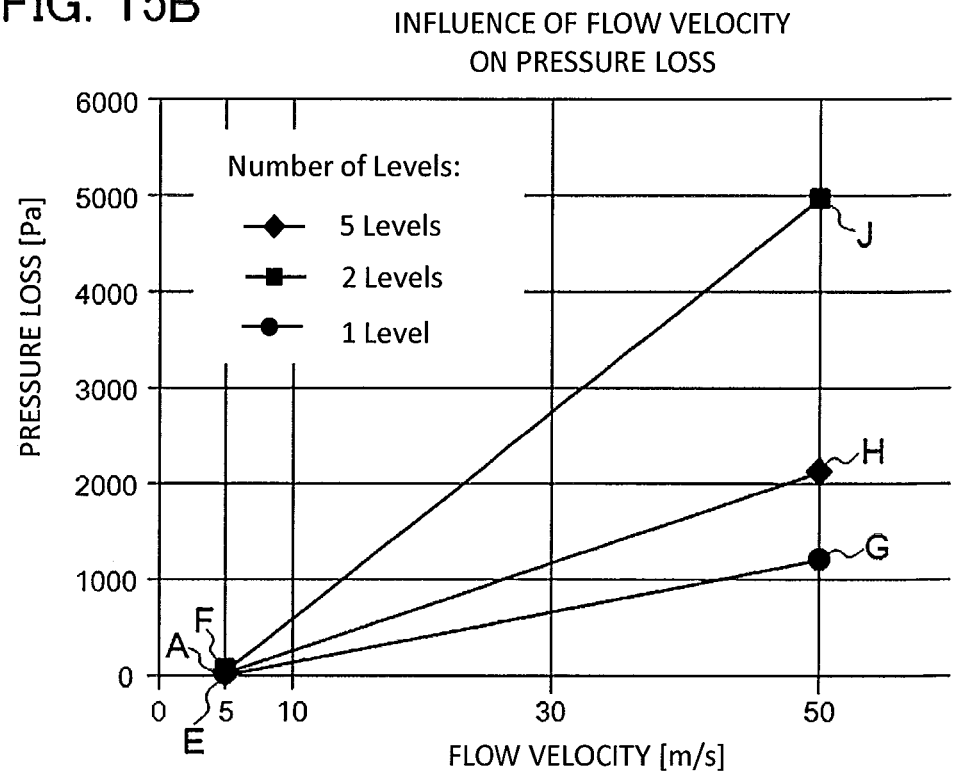
FIG. 15B is a graph illustrating influence of a flow velocity of arc extinguishing gas passing through a heat removal unit on a pressure loss.

Further, FIG. 15A illustrates influence of a flow velocity on a heat removal effect as evaluation results of Examples F, J, Examples A, H, and Examples E, G in Table 1 whose conditions other than the flow velocity are almost the same. Meanwhile, FIG. 15B illustrates influence of the flow velocity on a pressure loss regarding Examples F, J, Examples A, H, and Examples E, G above. As is known from the evaluation results illustrated in FIG. 15A and FIG. 15B, similarly to the evaluation results by FIG. 12A and FIG. 12B, application of a heat removal unit with heat removal members stacked in about five levels enables an excellent heat removal effect to be exhibited on arc extinguishing gas while suppressing a pressure loss of the arc extinguishing gas, under an environment where a velocity of fluid (arc extinguishing gas) is comparatively low.

Figure 16:
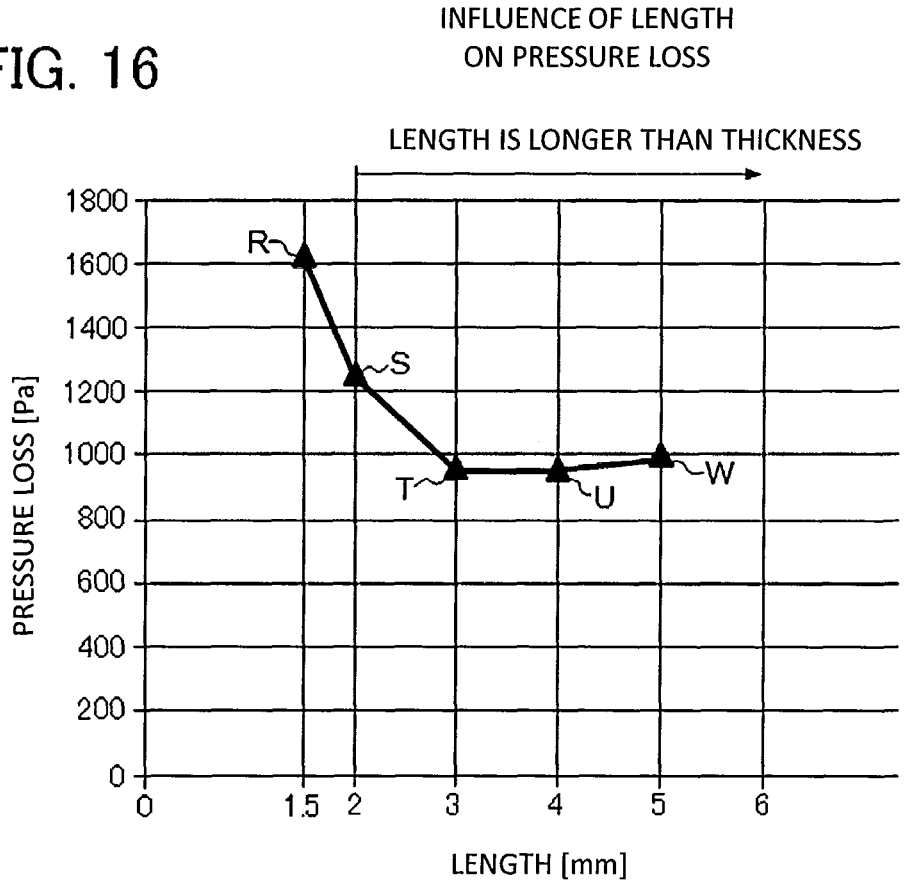
FIG. 16 is a graph illustrating influence of a length of a heat removal member on a pressure loss.

Further, FIG. 16 illustrates influence of a length of a heat removal member on a pressure loss as evaluation results of Examples R, S, T, U, W in Table 1 whose conditions other than a length L3 of the heat removal member illustrated in FIG. 9 are the same. To Examples R, S, T, U, W, heat removal members in which a thickness W1 of the thickest portion illustrated in FIG. 9 are each 1 mm are applied. As illustrated in FIG. 16, when the length is 1.5 mm to less than 2 mm in relation to the thickness of 1 mm, a slope of decrease in pressure loss is large, but when the length is 2 mm or more in relation to the thickness of 1 mm, the slope of decrease in pressure loss becomes comparatively gentle. Therefore, the length of the heat removal member along a flow direction of arc extinguishing gas is desirable to be twice or more the thickness of the thickest portion. Application of a heat removal unit having the heat removal member with such a length can attain a good heat removal effect on arc extinguishing gas while suppressing a pressure loss.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A gas-blast circuit breaker comprising at least one heat removal unit disposed in a flow path of arc extinguishing gas, wherein the at least one heat removal unit each includes:

a plurality of plate-shaped heat removal members each contacting the arc extinguishing gas flowing in the flow path to perform heat removal to the arc extinguishing gas; and a holding portion holding the plurality of plate-shaped heat removal members in a manner to stack the plurality of plate-shaped heat removal members at intervals with each other in a thickness direction, wherein each of the heat removal members includes:

an upstream side end portion provided on an upstream side in a flow direction of the arc extinguishing gas;

a downstream side end portion provided on a downstream side in the flow direction; and a thickest portion with a largest thickness which is provided between the upstream side end portion and the downstream side end portion, wherein a thickness of the heat removal member continuously changes between the upstream side end portion and the downstream side end portion via the thickest portion.

2. The gas-blast circuit breaker according to claim 1, wherein a surface of a portion in which the thickness continuously changes in the heat removal member is constituted by a curved surface or an inclined surface.

3. The gas-blast circuit breaker according to claim 1, wherein the holding portion holds the plurality of plate-shaped heat removal members in a status that the heat removal members are arranged in two or more levels in the flow direction.

4. The gas-blast circuit breaker according to claim 3, wherein the heat removal members adjacent to each other in the flow direction which are arranged in two or more levels are disposed in a manner that positions in a thickness direction are shifted each other or disposed in a manner that the positions in the thickness direction are in line.

5. The gas-blast circuit breaker according to claim 3, wherein the heat removal members adjacent to each other in the flow direction which are arranged in two or more levels are constituted by materials different from each other.

6. The gas-blast circuit breaker according to claim 1, wherein a length in the flow direction in the heat removal member is twice or more the thickness of the thickest portion.

7. The gas-blast circuit breaker according to claim 1, wherein a cross-sectional shape of the heat removal member in a case of being cut along its thickness direction is streamlined, rhombic, or elliptic.

8. The gas-blast circuit breaker according to claim 1, wherein a plurality of the heat removal units are disposed in a manner that the heat removal units are lined along the flow direction in the flow path.

9. The gas-blast circuit breaker according to claim 1, wherein the heat removal unit is constituted by a material having non-responsiveness against the arc extinguishing gas.

* * * * *